US005897023A

United States Patent [19]

Lee

[11] Patent Number: 5,897,023

[45] Date of Patent: Apr. 27, 1999

[54] TISSUE DISPENSING CARTON

[76] Inventor: Arnold Yoonho Lee, 4491 Deanwood Dr., Woodland Hills, Calif. 91364

[21] Appl. No.: 08/864,316

[22] Filed: May 28, 1997

[51] Int. Cl.[6] ..... B65H 1/00

[52] U.S. Cl. ..... 221/48; 221/63

[58] Field of Search ..... 206/494, 449, 206/555; 221/44, 47, 48, 63, 307

[56] References Cited

U.S. PATENT DOCUMENTS

| | | | |
|---|---|---|---|
| 1,699,425 | 1/1929 | Cicerchi | 221/307 |
| 1,718,952 | 7/1929 | Fischer | 221/307 |
| 2,232,425 | 2/1941 | Balton | 221/307 |
| 2,323,395 | 7/1943 | Harwood | 221/48 |
| 4,574,952 | 3/1986 | Masui | 206/494 |
| 4,858,784 | 8/1989 | Moody | 221/307 |
| 5,012,952 | 5/1991 | Franz | 221/44 |
| 5,038,970 | 8/1991 | Chich | 221/307 |
| 5,316,177 | 5/1994 | Boldt | 221/63 |

*Primary Examiner*—H. Grant Skaggs

[57] ABSTRACT

A dispensing carton for tissues, aluminum foils, plastic wraps or the like has a top portion which includes an elongated opening for withdrawing tissues from the carton. The dispensing carton includes a plurality of strings having first and second ends. The first ends are attached to one end of the opening and the second ends are attached to an opposite end of the opening. The plurality of strings are configured to form a slit for holding the tissues to prevent dropping into the carton. The strings may be made of any elastic strings, such as a common rubber band or elongated coils.

15 Claims, 3 Drawing Sheets

TISSUE DISPENSING CARTON

BACKGROUND OF THE INVENTION

1. Field of the Invention

This invention relates to a carton containing tissues, and more particularly to a dispensing carton containing facial tissues, or the like.

2. Description of Related Art

Disposable facial tissues are conventionally contained in a substantially rectangular carton having an elongated opening in the top surface. The carton contains a stack of interfolded tissues arranged such that they can be dispensed through the opening of the carton. One of the methods of dispensing the tissues from such a carton is through a restricted opening made of a thin plastic sheet or film having a slit across thereto, such that the tissue to be dispense is slightly pinched between the slit formed by the plastic sheet until extracted by a user. Because of the interfolded arrangement of the tissue sheets, the act of extracting one tissue from the carton will force the next sheet to partially protrude out of the carton through the plastic sheet opening, thus making the next sheet readily available for the user.

In order for the tissues to be releasably held by the plastic sheet opening, the opening must be configured to hold such tissues. However, there are instances where the tissue fails to lift up when the previous tissue is extracted by the user. In such instance, the user must insert a hand through the plastic sheet opening to grasp the tissue and pull it through the plastic sheet opening. The insertion of the hand through the limited opening to grasp the fallen tissue permanently destroys the integrity of the opening by enlarging the size of the slit or by tearing the slit. Moreover, as the tissues are extracted through the plastic sheet opening, paper particles or dusts are unsanitarily collected around the opening and on the plastic sheet.

In addition, certain coated paper, such as a wax paper, aluminum foil or plastic wrap might not be used with the opening formed by the plastic sheet because the weight of such a material cannot be supported by the pinching force created by the plastic sheet.

SUMMARY OF THE DISCLOSURE

It is an object of the present invention to provide a dispensing apparatus in which the contained materials, such as tissues or aluminum foils, can be withdrawn from the carton through an opening with reduced possibility of "loosing" the following sheet.

According to a first embodiment of the present invention, a dispensing carton has a top portion which includes an elongated opening for withdrawing tissues within the carton. The dispensing carton includes a plurality of elastic strings having first and second ends. The first ends are attached to one end of the opening and the second ends are attached to an opposite end of the opening. The plurality of elastic strings are configured to form a slit for holding the tissues to prevent falling into the carton.

According to one embodiment of the present invention, the plurality of elastic strings may be, a rubber band or elongated coils.

According to another embodiment of the present invention, a dispensing carton has an elongated opening formed in the top portion of the carton for withdrawing tissues within the carton. There are also first and second hooks securely positioned on the under surface of the top portion. The first hook is positioned substantially opposite of the second hook. An elastic band having first and second ends engages the first hook and the second hook, respectively. The elastic band is positioned so that it substantially traverses the elongated opening and forms a slit for holding the tissues.

In a yet another embodiment of the present invention, an opening formed in the top portion of the carton has a substantially straight edge. An elastic string having first and second ends is place adjacent to the straight edge thus forming a slit for holding tissues. The first end of the elastic string engages a first holder and the second end engages a second holder. The first and the second holders are securely positioned on the under surface of the top portion. The first and the second holders may be raised hooks, adhesives or other suitable fasteners for securely holding the elastic string.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
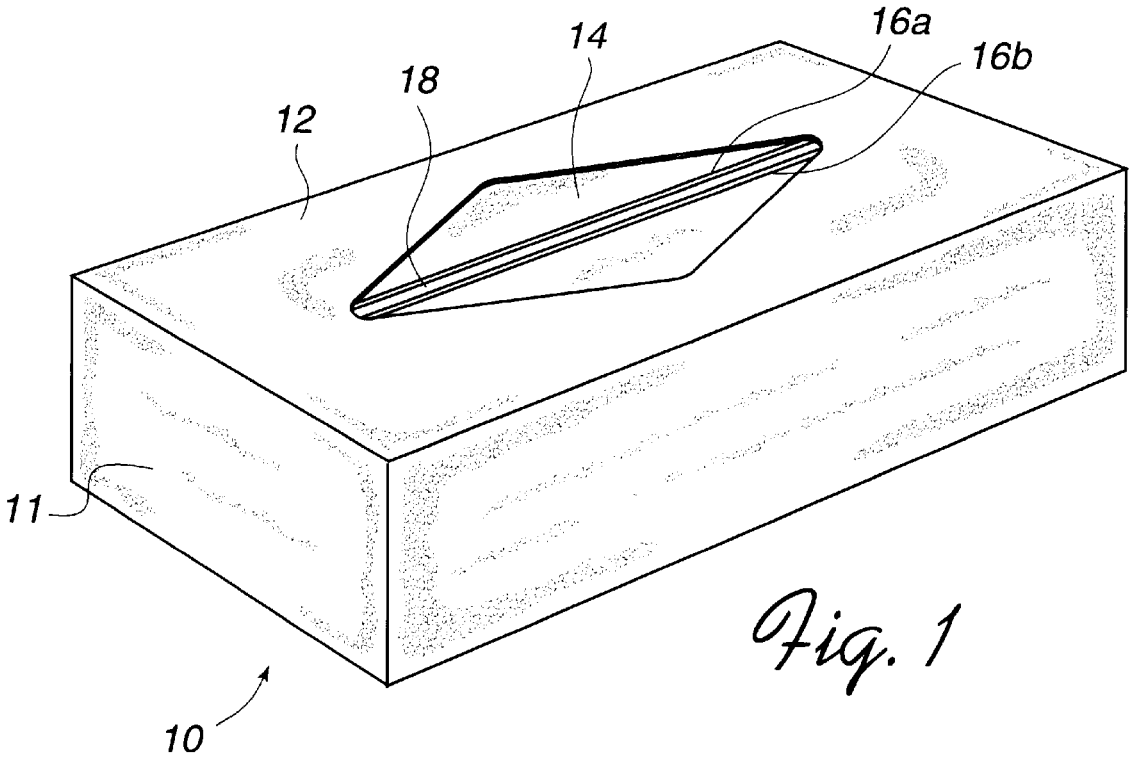
FIG. 1 illustrates a perspective view of a tissue carton of the present invention.
Figure 2:
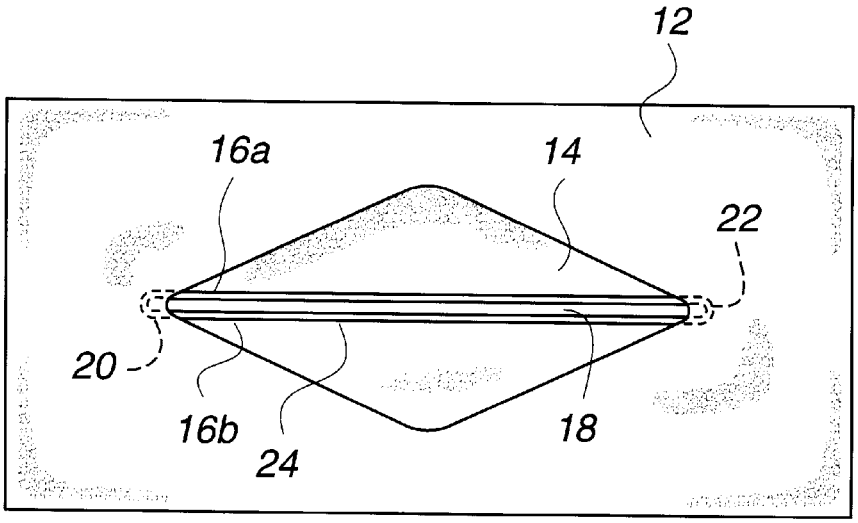
FIG. 2 illustrates a top view of the tissue carton of FIG. 1.
Figure 3:
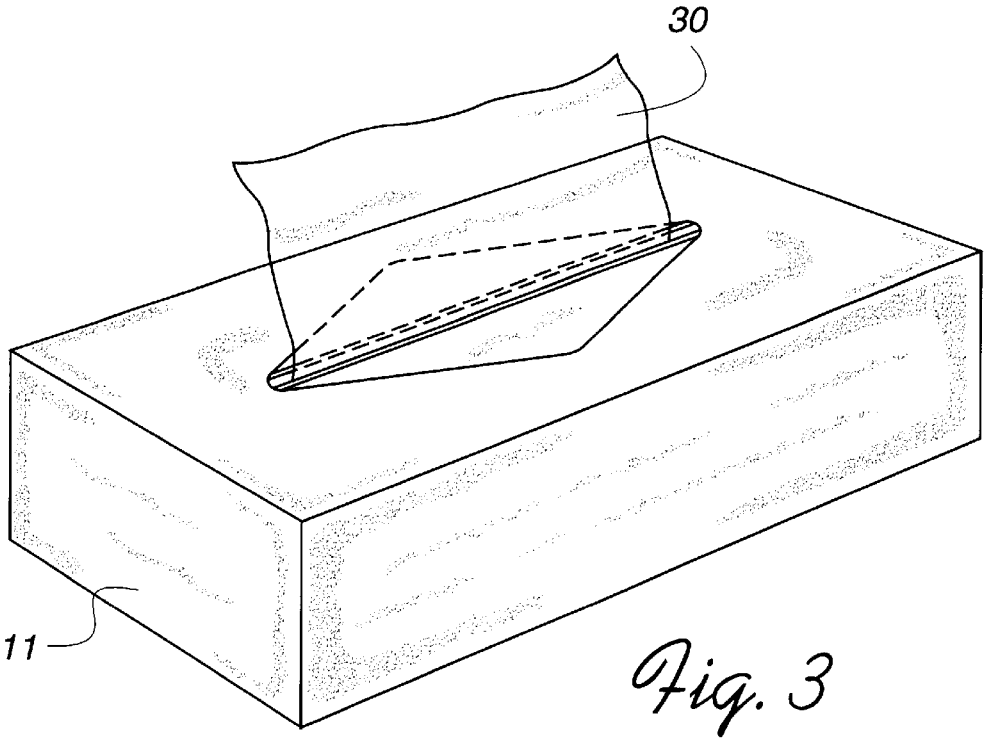
FIG. 3 illustrates a perspective view of a tissue carton with a tissue extruding through an opening.

Referring to FIGS. 1–3, the first embodiment of the tissue to dispensing carton 10 includes a carton 11 having a substantially rectangular shape. The carton 11 contains a stack of interfolded tissues arranged such that they can be dispensed through an elongated opening 14 formed on the top portion 12 of the carton 11. The elongated opening 14 is longitudinally formed and is sufficiently large for easy dispensing of the tissues or other materials within the carton 11. Across the elongated opening 14, there is a pair of elastic strings 16*a* and 16*b* arranged substantially close to each other to lightly pinch and hold a sheet of tissues contained in the carton 11. Two elastic strings 16*a* and 16*b* form a slot 18 or an opening which is longitudinally long enough to accommodate the width of the tissue and to allow the tissue easily pass through. The width of the slot 18 must be such that each tissue is held between the strings 16*a* and 16*b* without falling into the carton 11. The width of the slot 18 is substantially dictated by the separation distance of the first and the second elastic strings 16*a* and 16*b*, which is preferably about 1–3 mm. When using facial tissues as the content of the carton 11, the first and the second elastic strings 16*a* and 16*b* may be longitudinally abutting against each other to securely hold a single sheet of the tissue between them. If a thicker material is used, the separation distance between the first and the second elastic strings may be widened accordingly As shown in FIG. 2, the first and the second elastic strings 16*a* and 16*b* may preferably be formed of a single elastic band 24, such as a rubber band. The opposite ends 20 and 22 of the elastic band 24 is securely attached to the under surface of the top portion 12, which are shown in dotted lines in FIG. 2. Preferably, the elastic band 24 is attached to the under surface of the top portion 12 using hooks or any suitable fastener, such as adhesives, tapes or even staples.

It is preferable that the elastic band 24 (or the strings 16*a* and 16*b*) is placed on the under surface of the top portion 12 because a removable cover (not shown) is placed within the opening 14 when the carton is initially manufactured. The cover has a perforated line around the circumference of the opening, so that when the cover is removed, the opening is formed within the top portion 12. In addition, a transparent film (not shown) having an elongated opening may be place around the elastic band 24 to prevent dust and dirts from entering the inside of the carton.

FIG. 3 illustrates the first embodiment of the present invention with a tissue 30 protruding through the opening formed by the first and the second elastic strings 16*a* and 16*b* (or the elastic band 24 shown in FIG. 2). As shown, the tissue 30 is firmly placed in between the strings 16*a* and 16*b* and does not drop back into the carton 11.

When the tissue 30 is pulled from the carton 11, the pulling force of the tissue 30 will cause the first and the second elastic strings 16*a* and 16*b* to twist against each other. However, once the tissue 30 completely exits the carton, due to the elastic characteristic of the strings, the elastic strings 16*a* and 16*b* will untwist themselves to their original shape and will hold the next tissue in place.

In an event that the next tissue is not pulled up by the preceding tissue, a user can simply insert his hand between the first and the second elastic strings 16*a* and 16*b* and pull a tissue for positioning between the elastic strings 16*a* and 16*b*. Due to the elastic feature, the elastic strings 16*a* and 16*b* are initially stretched when the hand is inserted, but once the hand is removed, will maintain their original tension, position and shape.

Figure 4:
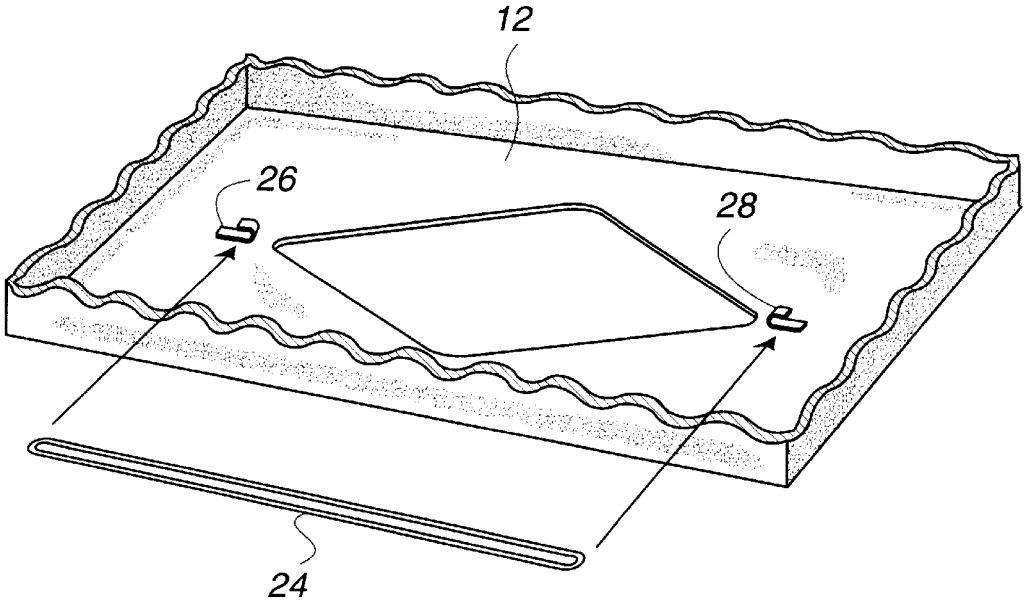
FIG. 4 illustrates how an elastic band is installed on the under surface of the top portion of the carton.

FIG. 4 shows how an elastic band 24 is installed on the under surface of the top portion 12 of the carton. As illustrated, the under surface of the top portion 12 preferably has two hooks 26 and 28 securely mounted for engaging two opposite ends of the elastic band 24. The hooks 26 and 28 may be made of a rigid material fastened to the under surface. Preferably, however, the hooks can be formed by a sufficiently thick paper glued to the under surface and partially latched to engage the elastic band 24. In particular, the first and the second hooks may be defined by raised surfaces configured (having indents) to engage the opposite ends of the elastic band 24 on the under surface of the top portion. The tissue dispensing carton may be equipped with a replacement elastic band so that when the original elastic band breaks, then the user can easily install the replacement elastic band by simply hooking the opposite ends to the preinstalled hooks 24 and 28.

The embodiments of the present invention may also be used with those materials sold in a roll form, such as aluminum foil, plastic wrap or the like, rather than individual sheets interfolded together. The use of the first and the second elastic strings 16*a* and 16*b* (or the elastic band) is the same in that the rolled material is inserted between the elastic strings. When a desired amount of the rolled material is withdrawn from a carton and tore off, the next leading portion of the rolled material stays erected and is easily accessible to the user.

In an alternative embodiment, the first and second elastic strings 16*a* and 16*b* (or an elastic band) may be positioned diagonally across the opening, instead of across the longitudinal axis of the elongated opening 14. Alternatively, the strings 16*a* and 16*b* may be positioned any where across the elongated opening 14 so long as the tissues within the carton are withdrawn without tearing.

Figure 5:
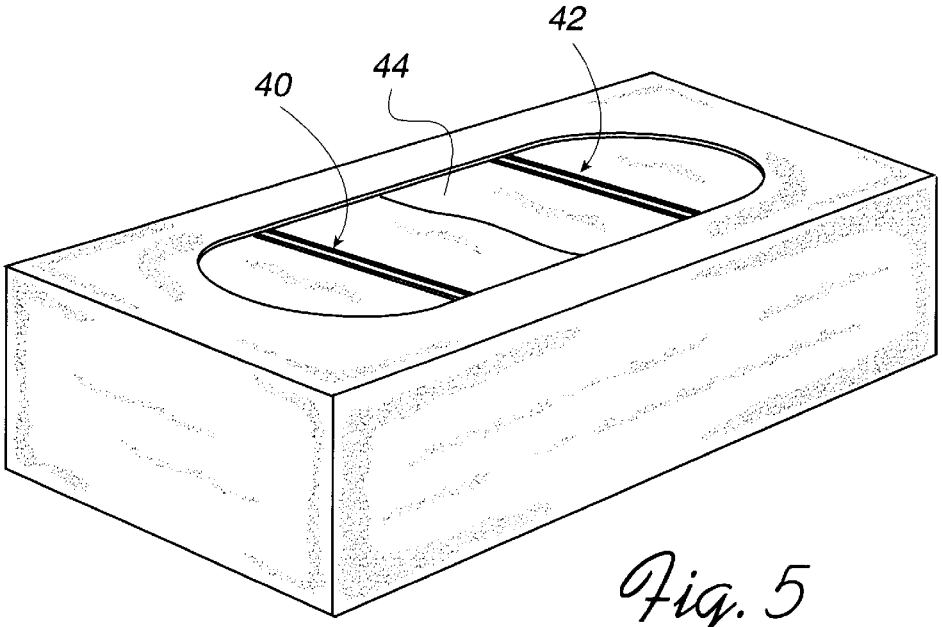
FIG. 5 illustrates a second embodiment of the present invention which uses two elastic bands for removing two separately interfolded tissues contained in the carton.

In addition, due to a simple installation of the strings 16*a* and 16*b* to the carton 11, there may be more than one set of strings secured to the top portion. This is useful when one carton contains, for example, two stacks of interfolded tissues (for example, with different colors) for a separate extraction from the carton. In such an embodiment, as shown in FIG. 5, two sets of elastic strings 40 and 42 may be installed across an elongated opening 44 so that a first set of strings is used to withdraw a first stack of tissues and a second set of strings is used to withdraw a second stack of tissues.

Figure 6:
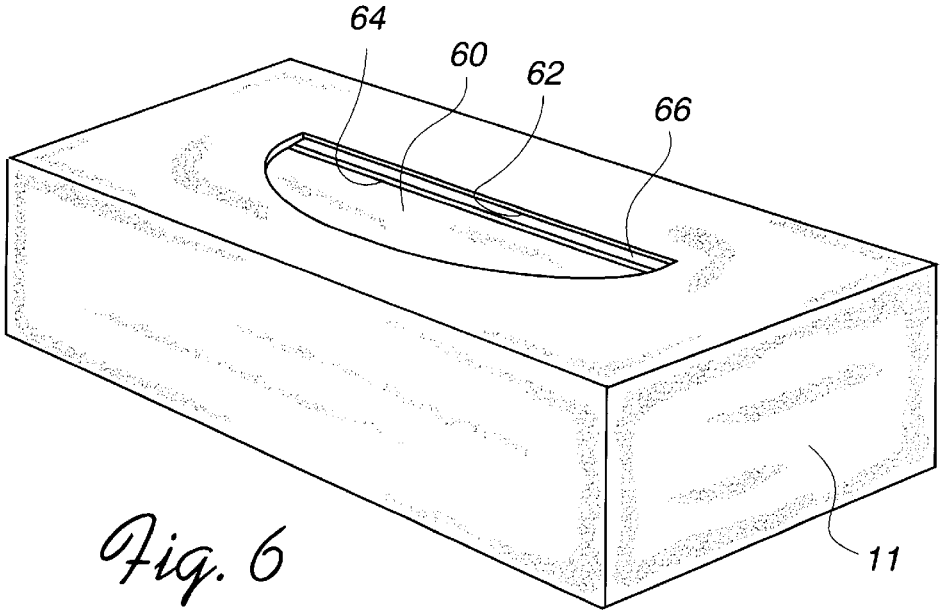
FIG. 6 illustrates a third embodiment of the present invention which uses one elastic string adjacent to an edge of the opening formed in the top portion of the carton.

A third embodiment of the present invention is illustrated in FIG. 6. In FIG. 6, the carton 11 containing, for example, facial tissues, has an opening 60. The opening 60 includes an edge 62 which is formed substantially in the middle of the top portion of the carton 11. An elastic string 64 is placed adjacent to the edge 62 to form a slit 66 for releasably holding a tissue contained in the carton 11. The separation distance between the edge 62 and the elastic string 64 is sufficiently narrow, preferably about 1–3 mm, so that a single sheet of tissue is pinched between them. Each end of the elastic string 64 is securely attached by using adhesives, tapes, stapes or other suitable means to the underside of the top portion of the carton 11.

When a tissue is pulled from the carton 11, the pulling force of the tissue will either enlarge the slit 66 by stretching the elastic string 64 and/or allow the elastic string 64 to twist against the edge 62 until the tissue is completely separated from the carton 11. However, once the tissue completely exits the carton 11, due to the elastic characteristic, the elastic string 64 will untwist itself to its original shape and will hold the next tissue in place.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A dispensing carton for dispensing interfolded sheets, the carton comprising:

a wall defining an opening for withdrawing the interfolded sheets disposed within the carton; and a plurality of strings having first and second ends arranged substantially in parallel to each other, wherein the first ends are attached to one end of the opening and the second ends are attached to an opposite end of the opening, and wherein the plurality of strings are coplanarily arranged at a close proximity to each other to form a slit sufficiently narrow, wherein when one of the interfolded sheets is withdrawn through the slit, a subsequent one of the interfolded sheets is trapped and frictionally engaged between the plurality of strings to prevent gravitational withdrawal of the interfolded sheets back into the carton.

2. A dispensing carton of claim 1, wherein the plurality of strings include elastic strings.

3. A dispensing carton of claim 1, wherein the plurality of strings include an elastic band.

4. A dispensing carton of claim 3, wherein the elastic band is a rubber band.

5. A dispensing carton of claim 1, wherein the plurality of strings include coils.

6. A dispensing carton of claim 1, wherein a width of the slit is about 1 mm to 3 mm.

7. A dispensing carton for dispensing interfolded sheets, the carton comprising:

a wall defining an elongated opening through which the interfolded sheets are withdrawn; and a pair of elastic strings having first and second ends, wherein the first ends are attached to one end of the elongated opening along the longitudinal axis and the second ends are attached to an opposite end of the elongated opening, and wherein the pair of elastic strings are coplanarily arranged at a close proximity to each other to form a slit sufficiently narrow, wherein when one of the interfolded sheets is withdrawn through the slit, a subsequent one of the interfolded sheets is trapped and frictionally engaged between the plurality of strings to prevent gravitational withdrawal of the interfolded sheets back into the carton.

8. A dispensing carton of claim 7, wherein a separation distance between the pair of elastic strings is sufficiently narrow to releasably hold the interfolded sheets.

9. A dispensing carton of claim 7, wherein a separation distance between the pair of elastic strings is adjustable in response to the thickness of the interfolded sheets contained in the carton.

10. A dispensing carton for dispensing interfolded sheets, the carton comprising:

a wall of the carton defining an opening for withdrawing the interfolded sheets from the carton;

first and second holder securely positioned on the under surface of the wall, wherein the first holder is positioned substantially opposite of the second holder; and an elastic string having first and second ends, wherein the first end engages the first holder and the second end engages the second holder, and wherein the elastic string substantially traverses across the opening is coplanarily arranged at a close proximity to an edge of the opening to form a slit with the edge of the opening, the slit being sufficiently narrow, wherein when one of the interfolded sheets is withdrawn through the slit, a subsequent one of the interfolded sheets is trapped and frictionally engaged between the elastic string and the edge of the opening to prevent gravitational withdrawal of the interfolded sheets back into the carton.

11. A dispensing carton of claim 10, wherein a width of the slit is sufficiently narrow to hold and to release the interfolded sheets without tearing.

12. A dispensing carton of claim 10, wherein a width of the slit is about 1 mm to 3 mm.

13. A dispensing carton of claim 10, wherein the first and the second holders are hooks comprising a rigid material fastened on the under surface of the wall.

14. A dispensing carton of claim 13, wherein the first and the second hooks are defined by raised surfaces configured to engage the first and the second ends of the elastic string on the under surface of the wall.

15. A dispensing carton of claim 10, wherein the first and the second holders include adhesives for securely mount the first and the second ends of the elastic string to the under surface of the wall.

* * * * *